US007226279B2

(12) United States Patent
Andoskin et al.

(10) Patent No.: US 7,226,279 B2
(45) Date of Patent: Jun. 5, 2007

(54) GEROTOR MECHANISM FOR A SCREW HYDRAULIC MACHINE

(75) Inventors: Vladimir Nikolaevich Andoskin, Perm (RU); Sergei Petrovich Astafiev, Perm (RU); Maksim Anatolievich Pushkarev, Perm (RU); Aleksei Sergeevich Glinkin, Perm (RU); Mikhail Valerievich Fadeev, Perm (RU)

(73) Assignee: Obschestvi S Ogranichennoi Otvetstvennostyu "Firma Radius-Servis" (RU)

( * ) Notice: Subject to any disclaimer, the term of this patent is extended or adjusted under 35 U.S.C. 154(b) by 0 days.

(21) Appl. No.: 10/550,245

(22) PCT Filed: Feb. 3, 2004

(86) PCT No.: PCT/RU2004/000031

§ 371 (c)(1),
(2), (4) Date: Sep. 23, 2005

(87) PCT Pub. No.: WO2004/085798

PCT Pub. Date: Oct. 7, 2004

(65) Prior Publication Data

US 2006/0216183 A1 Sep. 28, 2006

(30) Foreign Application Priority Data

Mar. 25, 2003 (RU) ..... 2003108246

(51) Int. Cl.
*F03C 2/00* (2006.01)
*F04C 2/00* (2006.01)

(52) U.S. Cl. ..... 418/48; 418/150; 418/152; 418/156; 175/106; 175/107

(58) Field of Classification Search ..... 418/48, 418/150, 152, 153, 156; 175/106, 107
See application file for complete search history.

(56) References Cited

U.S. PATENT DOCUMENTS 3,286,642 A * 11/1966 Lindberg ..... 418/48
3,380,391 A * 4/1968 Willy ..... 418/48
4,567,953 A * 2/1986 Baldenko et al. ..... 418/48
5,120,204 A * 6/1992 Mathewson et al. ..... 418/48

FOREIGN PATENT DOCUMENTS

DE 3345419 A * 6/1985
DE 3345419 A1 6/1985
GB 2 084 254 A 4/1982

(Continued)

*Primary Examiner*—Theresa Trieu
(74) *Attorney, Agent, or Firm*—Fitch, Even, Tabin & Flannery

(57) ABSTRACT

The invention relates to gerotor mechanisms for screw downhole motors used for drilling oil and gas wells, to screw pumps for producing oil and pumping fluids and to general purpose screw motors. The profiles of a rotor (3) and stator (1) are outlined in the end cross section thereof in the form of the envelop of the initial contour of a rack-type tool, which is formed by conjugation of circle arcs when said initial contour of the rack-type tool is run without sliding along corresponding tool circles. The arc radii of the circle arcs of the initial contour are calculated according to determined relations. Said invention makes it possible to improve energy characteristics, increase a life service and producibility, to reduce hydromechanical losses and costs.

3 Claims, 8 Drawing Sheets

FOREIGN PATENT DOCUMENTS

| | | | | | |
|---|---|---|---|---|---|
| GB | 2152588 | A | * | 8/1985 | ..... 418/150 |
| JP | 59173584 | A | * | 10/1984 | ..... 418/150 |
| JP | 61201891 | A | * | 9/1986 | ..... 418/150 |
| RU | 2 165 531 | C1 | | 4/2001 | |
| RU | 2165531 | C1 | * | 4/2001 | |
| RU | 2 166 603 | C1 | | 5/2001 | |
| RU | 2166603 | C1 | * | 5/2001 | |
| RU | 2 194 880 | C2 | | 12/2002 | |
| RU | 2194880 | C2 | * | 12/2002 | |

* cited by examiner

GEROTOR MECHANISM FOR A SCREW HYDRAULIC MACHINE

This application is a U.S. national phase application filed under 35 U.S.C. § 371 of international application PCT/RU2004/000031, filed on Feb. 3, 2004, designating the United States, which claims the benefit of Russian Application Ser. No. 2003108246, filed on Mar. 25, 2003, which are hereby incorporated by reference herein.

FIELD OF THE INVENTION

The invention relates to gerotor mechanisms of the screw downhole motors used for drilling the oil and gas wells, to the screw pumps employed for extracting oil and for pumping fluids, and also relates to the general-purpose screw hydraulic motors.

BACKGROUND OF THE INVENTION

Known is a multi-lead screw gerotor mechanism for a screw downhole motor, comprising: a stator having inner helical teeth made of a resilient-elastic material, e.g. of rubber; and a rotor having outer helical teeth, number of which outer teeth by one tooth is less than that of the stator teeth; the rotor axis being shifted with respect to the stator axis by the eccentricity value being half of the teeth's radial height; profiles of the rotor s outer teeth and stator's inner teeth are mutually-enveloping when viewed in the end-face section; and leads of the rotor and stator teeth being proportional to a number of their teeth (see patent RU 2165531, IPC P01C 1/16, 5/04, E21B4/02, 2000).

In the prior-art designs, profiles of the stator and rotor teeth, when viewed in the end-face section, are implemented as the envelopes of the common initial contour of the cycloidal rack defined by the curtailed cycloid equidistance. In this end-face section, thickness $C_t$ of the stator tooth across the mean diameter $D_m$ of the teeth and circular pitch $S_t$ of these teeth are interrelated according to the following ratio: $C_t/S_t$=0.45 0.65; and thickness $C_N$ of the stator tooth across the mean diameter $D_m$, when viewed in the section perpendicular to the stator tooth's screw line direction, and the stator's tooth radial height h are interrelated according to the following ratio: $C_N/h \geqq 1.75$.

A drawback of this known gerotor mechanism consists in that the total diametric interference in the mechanism is distributed among the stator teeth in the manner that the stator tooth projection is deformed significantly more than its space, so that the rotor axis may shift toward the eccentricity decrease and, consequently, the designed kinematics of the gerotor mechanism may be departed from, wear of apices of the rotor and stator teeth may become more intense, the interference in the pitch point zone may weaken, and service life of a gerotor mechanism may become briefer.

Said drawback is partially mitigated in the gerotor mechanism, comprising: a stator having inner helical teeth made of a resilient-elastic material, e.g. of rubber; and a rotor having outer helical teeth, number of which outer teeth by one tooth is less than that of the stator teeth; the rotor axis being shifted with respect to the stator axis by the eccentricity value being half of the teeth's radial height; leads of the rotor s and stator's helical teeth are proportional to numbers of their teeth [patent RU 216603, IPC E21B 4/02, 2000].

The stator teeth's profile, when viewed in the end-face section, is implemented as the envelope of the initial contour of the cycloidal rack defined by the equidistance having radius $R_{C1}$ of the curtailed cycloid; and the rotor teeth profile, when viewed in the end-face section, is implemented as the envelope of the outer initial contour of the cycloidal rack having radius $R_{C2}$ of equidistance, which radius is greater than $R_{C1}$ or obeys the following ratio: $R_{C2}=R_{C1}+(0.1 \ldots 0.5)$ E, where E is the generating circle radius being equal to the eccentricity value [see said patent No. 2166603].

Another version of said know design of a gerotor mechanism is such that the stator teeth's profile, when viewed in the end-face section, is implemented as the envelope of the initial contour of the cycloidal rack defined by the equidistance having radius $R_{C1}$ of the curtailed cycloid; and the rotor teeth's profile, when viewed in the end-face section, is defined by the conjugated circular arcs; the rotor tooth's projection being defined by arc of radius $R_B$, which radius is greater than radius $R_{C1}$ of the stator equidistance, or interrelates with said radius according to the following ratio: $R_{C2}=R_{C1}+(0.1 \ldots 0.5)$ E, and the rotor tooth's space profile is defined by the arc having radius $R_V$, which radius depends on a number of rotor's teeth, inner diameter and eccentricity of said rotor (see said patent No. 2166603].

A drawback of the above-recited design is as follows: as the lateral and diametric interferences, evenly distributed, take place, high contact stresses arise and reach their maximum at minimal angles of pressure, which results in one-sided frictional wear of the teeth (at the left side of the rotor teeth, when viewed from the working fluid delivery side), and the friction forces, that develop in meshing, bring about the moments of resistance that prevent the rotor from rotating about its axis and from its planetary motion, which circumstances impair the energy characteristics of a given mechanism.

The device most pertinent to the claimed invention is a multi-lead gerotor mechanism of a screw hydraulic motor, comprising the following constituents: a stator having inner helical teeth made of a resilient-elastic material, for example of rubber; and a rotor having outer helical teeth whose number is one tooth less than that of the stator's teeth; the rotor axis having been shifted with respect to the stator axis by the eccentricity value being equal to half of the teeth's radial height, the end-face profile of teeth of one of the constituents is implemented as the envelope of the initial contour of the rack defined by the curtailed cycloid equidistance with a shift; and the end-face profile of teeth of the other constituent is implemented as the equidistance of envelope of the first constituent when their centroids are revolved around without slippage, and the equidistance value being half of the value of the diametric interference in meshing (patent RU 2194880, IPC F04C 2/16, F04C 5/00, 20 Dec. 2002].

A drawback of said design consists in that it does not take into account the conditions of sliding of the rotor's helical teeth on those of the stator, i.e. in the zone farthermost from the immediate centre of rotation (from the pitch point), where the sliding speeds are the greatest; and due to the evenly distributed interference there takes place a more severe wear of the resilient-elastic teeth of the stator and that of the rotor teeth's wear-resistance cladding. Another drawback consists in that the operation conditions of the gerotor mechanism are not taken into account (temperature, nature of the loads occurring in drilling of rocks of various hardness and composition); for example for the hot wells having a work temperature over 100° C., use of the gerotor mechanisms having a clearance in the rotor-stator meshing is required. The use, in such wells, of gerotor mechanisms having the in-meshing interference may result in a more severe wear, a sharp fall of efficiency and seizure of a mechanism. Another drawback of the known device is lack of possibility of varying the interference and of correlation adjustment of shapes of the rotor and stator teeth without changing the rotor and/or stator outer diameters, which does not allow to provide a reliable tightness along the contact lines in the gerotor mechanism, with zero interference in meshing.

SUMMARY OF THE INVENTION

The technical settled by the claimed invention is an improvement of the energy characteristics of the gerotor mechanism in a hydraulic motor when a hydraulic power is applied thereto and when the resulting pressure difference appears in its working members, a prolonged service life and reduced hydro-mechanical losses by virtue of provision of the lateral interference in meshing, an improved tightness along the contact lines and lower contact stresses in the maximum sliding speeds zone by way of re-distribution of the in-meshing interference and optimization of said interference depending on a distance between the immediate centre of rotation (pitch point) and the profiles contact zone.

Another technical problem is an improved manufacturability and lower cost of the gerotor mechanism by way of simplification of selection of the working pairs according to their radial interference, as well as improved energy characteristics of a gerotor mechanism in conformity with the operation conditions, e.g. for hot wells by way of decreasing the lateral interference or through provision of the side clearance in conjunction with the constant radial interference.

The above problems are settled by providing a gerotor mechanism for a screw hydraulic machine, said mechanism comprising a stator having inner helical teeth made of a elastoplastic material, e.g. of rubber, and a rotor having outer helical teeth whose number by one tooth is less than that of the stator, leads of screw lines in the stator and the rotor being proportional to numbers of their teeth, the rotor axis being shifted with respect to the the stator axis by the eccentricity value being equal to half of the teeth radial height; characterizing in that profiles of the rotor and/or the stator are outlined in the end cross section thereof in the form of the envelop of the initial contour of a rack-type tool, which contour is formed by conjugation of circle arcs when said initial contour of the rack-type tool is run without sliding along corresponding tool circles, the radii of the circle arcs of the initial contour being calculated according to the following expressions:

$$r_i=K[(\pi^2 r_{w1}^2/4Ez_1^2)+E]/(K+1)$$

or $$r_i=K[(\pi^2 r_{w2}^2/4Ez_2^2)+E]/(K+1),\ r_c=r_i/K,$$

where $r_i$ is the initial radius of the rack-type tool profile,

K=(0, 5 . . . 2) is the initial contour shape coefficient, $r_{w1}$, $r_{w2}$ are radii of the tool circles of the rotor and the stator, respectively;

E is eccentricity of meshing, $z_1$, $z_2$ are numbers of teeth of the stator and the rotor, respectively;

$r_c$ is the conjugated radius of the rack-type tool profile.

Preferably, the profile of a half of each of the teeth in end cross section of the rotor and/or the stator is defined as the envelope of the rack-type tool initial contour formed by the curtailed cycloid equidistance when the rack-type tool initial contour is run without sliding along the corresponding tool circle.

Said ratios for the rack-type tool initial contour being obeyed and in assembling of gerotor mechanisms having different versions of profiles; a possibility for providing the in-meshing lateral interference is ensured. Thus, a reliable tightness along the contact lines is achieved when hydraulic-power fluid flows are delivered to a hydraulic motor; and a possibility to reduce the in-meshing radial interference and to assemble the working pairs without their selection is brought about. The moment of resistance forces is lowered owing to a weaker radial interference and lighter contact stresses effected on the areas farthermost from the immediate centre of rotation (from the pitch point), that is in the maximum sliding speeds zone. Conditions of sliding of the rotor's helical teeth over the stator's helical teeth are accommodated by virtue of re-distribution of the in-meshing interference towards the decrease thereof from the minimum sliding speeds zones to those of the maximum sliding speeds.

Apart from that, selection of coefficient X allows to

- modify the lateral interferences in meshing, with the constant radial interference;
- provide the side clearance in meshing, when the radial interference is present;
- provide the radial clearing in meshing, when the lateral interference is present.

When profile of one half of each one of the teeth in the end-face section of the rotor and/or stator is implemented as the envelope of the rack-type tool initial contour generated by the curtailed cycloid equidistance; and when profile of the other half of the rotor and/or stator s tooth is implemented as the envelope of rack-type tool initial contour generated by conjugation of circular arcs: these arrangements also allow to take into account conditions of operation of the mechanism and mitigate the one-sided wear of teeth.

Coefficient K of the initial contour shape is selected depending on conditions of operation of a gerotor mechanism and in view of versions of assembly thereof, for example—for provision of the lateral interference in meshing of the rotor, having the helical teeth profile according to the claimed invention, with the stator having the profile defined by the cycloidal rack: said coefficient K is selected to be greater than, or equal to 1. A radial interference value depends on the selected values of the rack-type tool initial contour shift in formation of the conjugated profiles. If coefficient K is less than 0.5, the rotor tooth thickness diminishes excessively and that of the stator increases accordingly; and if K exceeds 2, the rotor tooth thickness increases excessively and that of the stator diminishes accordingly, which circumstance excludes any possibility to use the claimed rotors and/or stators with those of the gerotor mechanisms operated in Russia.

THE BEST MODE FOR EMBODYING THE INVENTION

Figure 1:
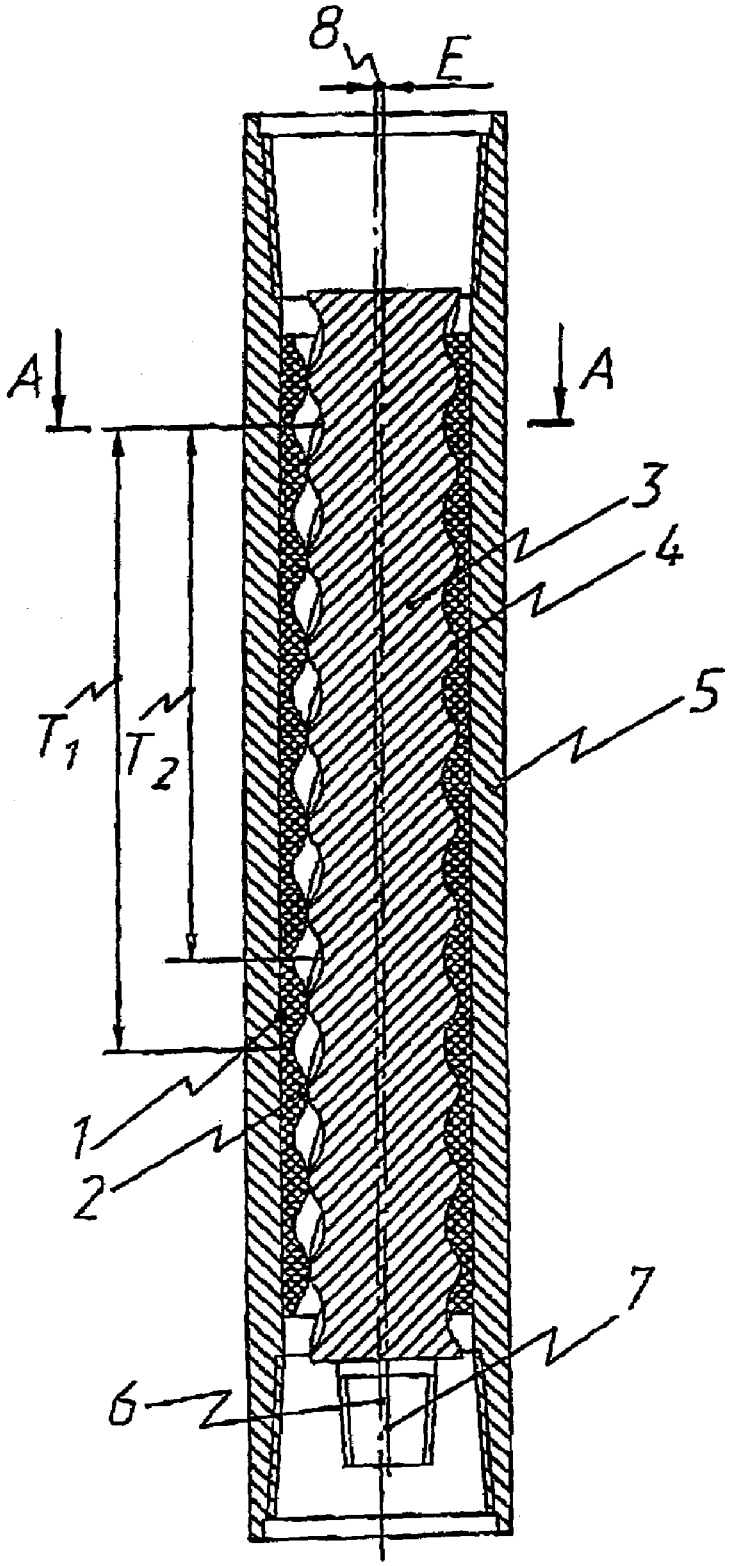
FIG. 1 shows a longitudinal section of a gerotor mechanism associated with a screw-type downhole hydraulic motor.
Figure 2:
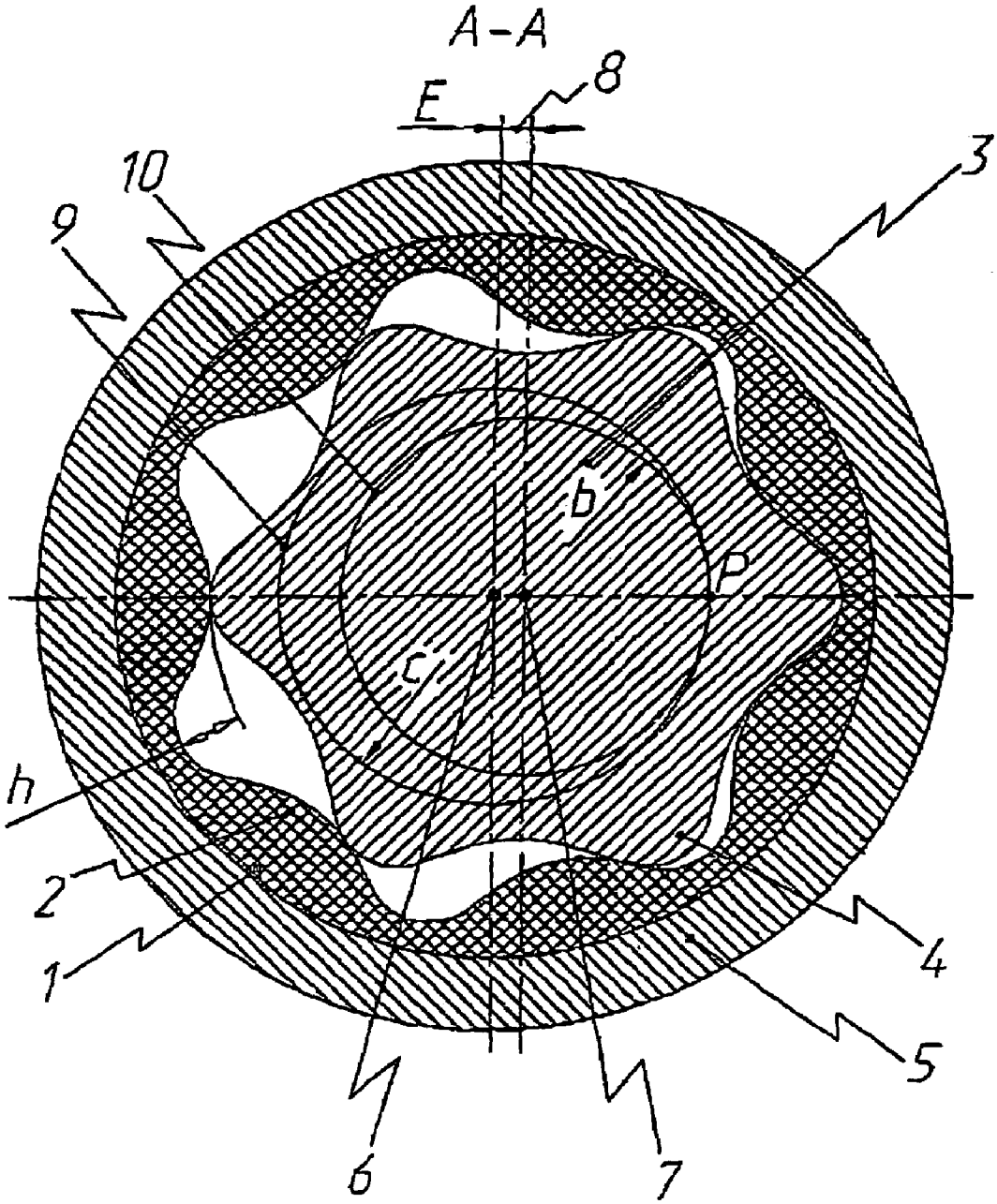
FIG. 2 shows a cross-section of the gerotor mechanism taken along line A—A.

A gerotor mechanism of a screw hydraulic motor, as shown in FIGS. 1, 2, comprise stator 1 having inner helical teeth 2, rotor 3 having outer helical teeth 4 whose number by one tooth is less than those of inner helical teeth 2 of stator 1. Inner helical teeth 2 of stator 1 are made of a resilient-elastic material, for example of rubber cured onto the inner surface of body 5 of stator 1. Axis 6 of stator 1 has shifted with respect to axis 7 of rotor 3 by eccentricity 8 whose value E is equal to half of radial height of teeth 2 and 4. Working centroid 9 (the initial circumference) of stator 1 having radius $c=Ez_1$ is in tangency to working centroid 10 (of the initial circumference) of rotor 3 having radius $b=Ez_2$ in pitch point P, see FIG. 2. Leads of screw lines T1 and T2 of teeth 2 and 4 of, respectively, stator 1 and rotor 3, in FIG. 1, are proportional to numbers of their teeth $z_1$ and $z_2$.

Figure 3:
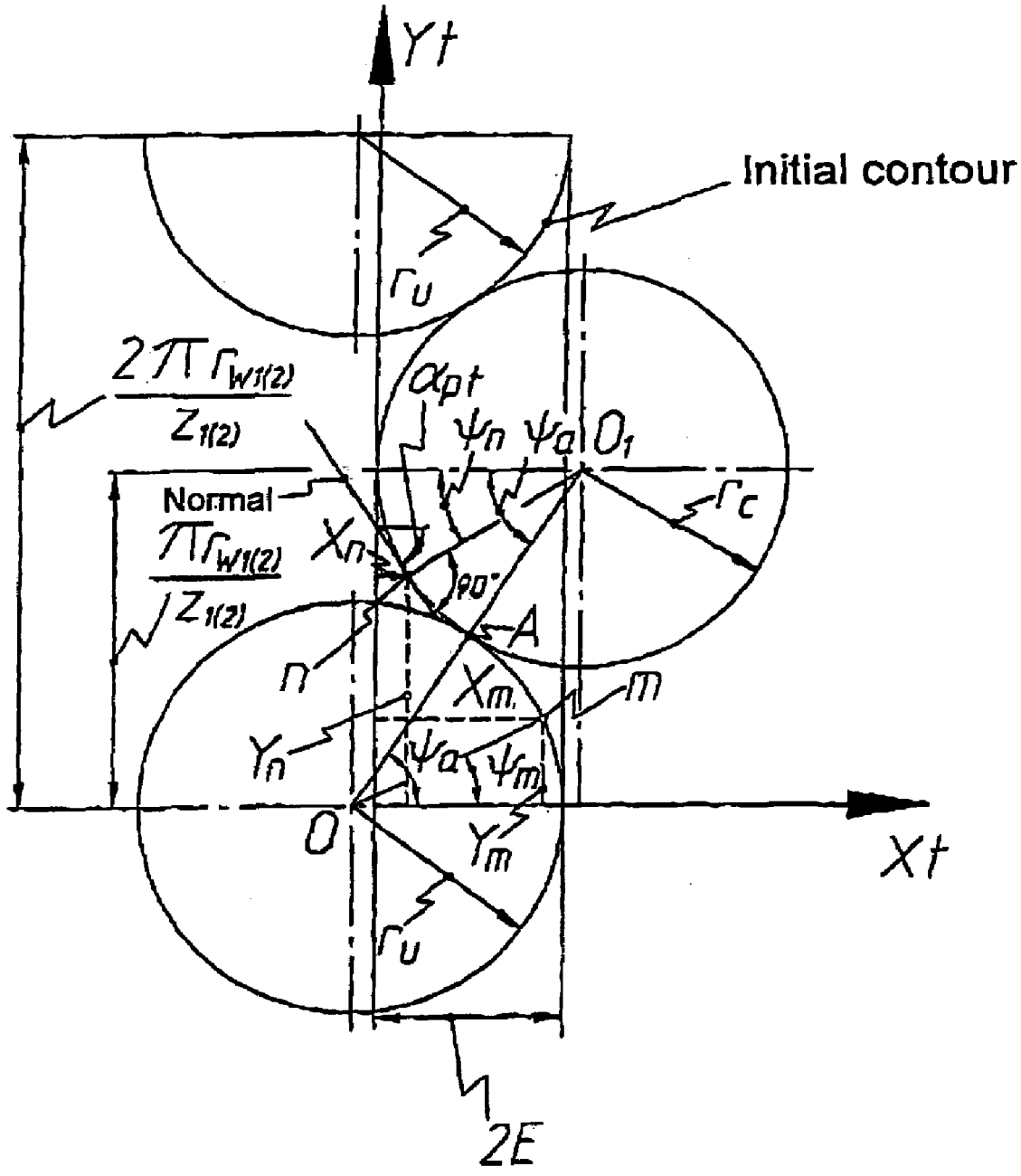
FIG. 3 shows a diagram for generating the rack-type tool initial contour by conjugating the circular arcs having radii $r_i$ and $r_c$.

The essential feature of the rack-type tool initial contour of the gerotor mechanism according to the invention consists in that said contour is generated by conjugation of circular arcs, according to FIG. 2, and the initial radius of one of said arc is determined by the following expressions:

$$r_i=K[(\pi^2 r_{w1}^2/4Ez_1^2)+EJ/(K+1),$$

or $$r_i=K[(\pi^2 r_{w2}^2/4Ez_2^2)+EJ/(K+1),$$

and the conjugated radius of the other arc is determined as $$r_c=r_i/K;$$

and coordinates of the current points m and n of the initial contour are determined by the following expressions:

$$X_m=r_i(\cos(\Psi_m)-1)+2E,$$

$$Y_m=r_i\sin\Psi_m,$$

$$X_n=r_c(1-\cos\Psi_n),$$

$$Y_n=(\pi r_{w1(2)}/z_{:1(2)})-r_c\sin\Psi_n,$$

where $\Psi_m=(0 \ldots \Psi_a)$, $\Psi_n=(0 \ldots \Psi_a)$ are the central angles having a selected discreteness on the areas of the initial contour having radii $r_i$ and $r_c$, respectively;

$\Psi_a=\arcsin[(\pi r_{w1(2)}/2_{1:(2)})/(r_i+r_c)]$ is the central angle of the initial contour at the conjugation point of the circular arcs. The contour formed by the circular arcs has the height of 2E and the length of $2\pi r_{w1(2)}/z_{:1(2)}$. Here the angle of the profile of the initial contour conjugated by the circular arcs is determined by the following expressions:

$$\alpha_{pt}=(\pi/2)-\Psi_m,$$

or $$\pi_{pt}=(\pi/2)-\Psi_n:$$

see FIG. 3.

Figure 4:
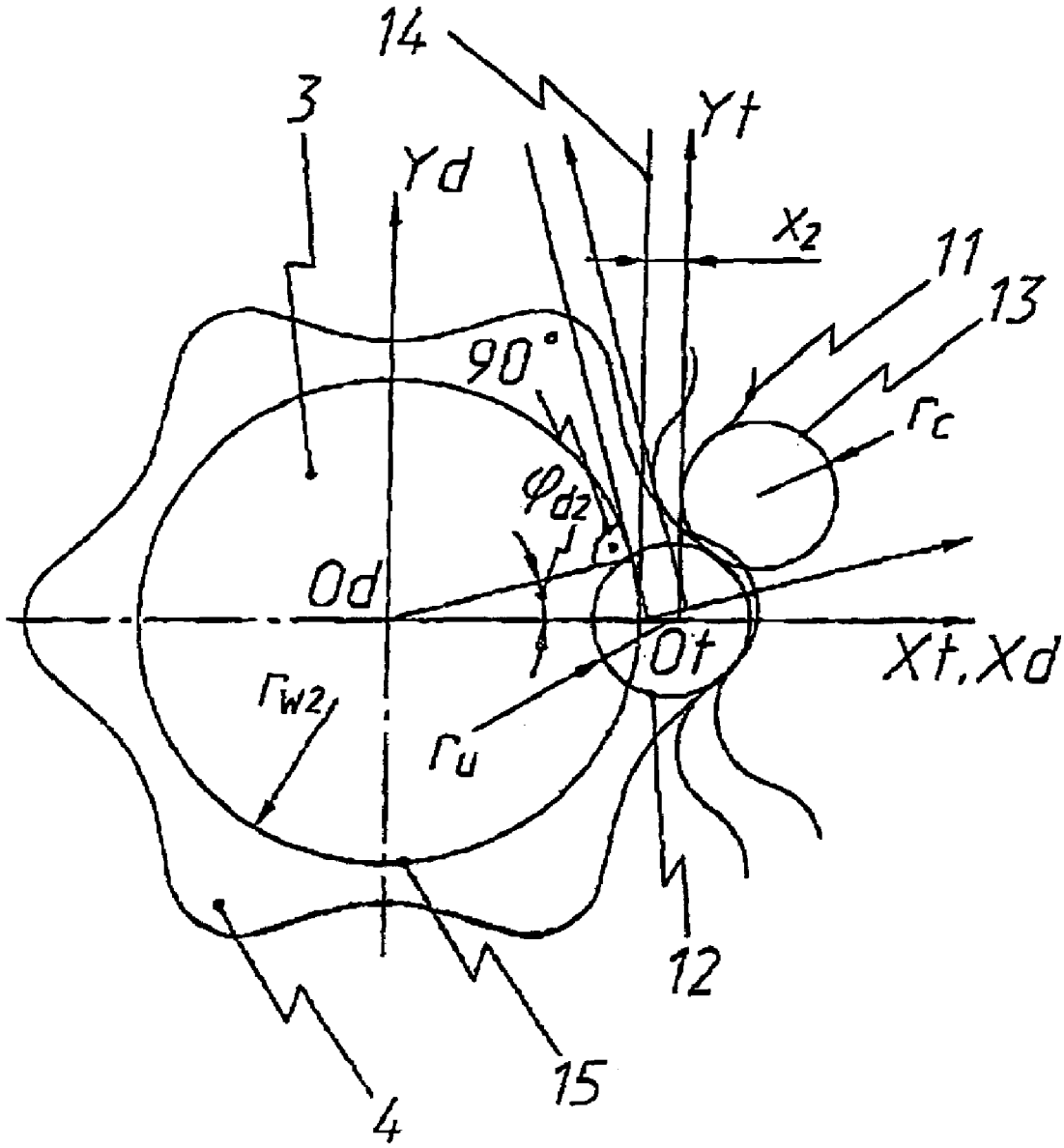
FIG. 4 shows a diagram for generating the rotor profile basing on the rack-type tool initial contour generated by conjugation of circular arcs.
Figure 5:
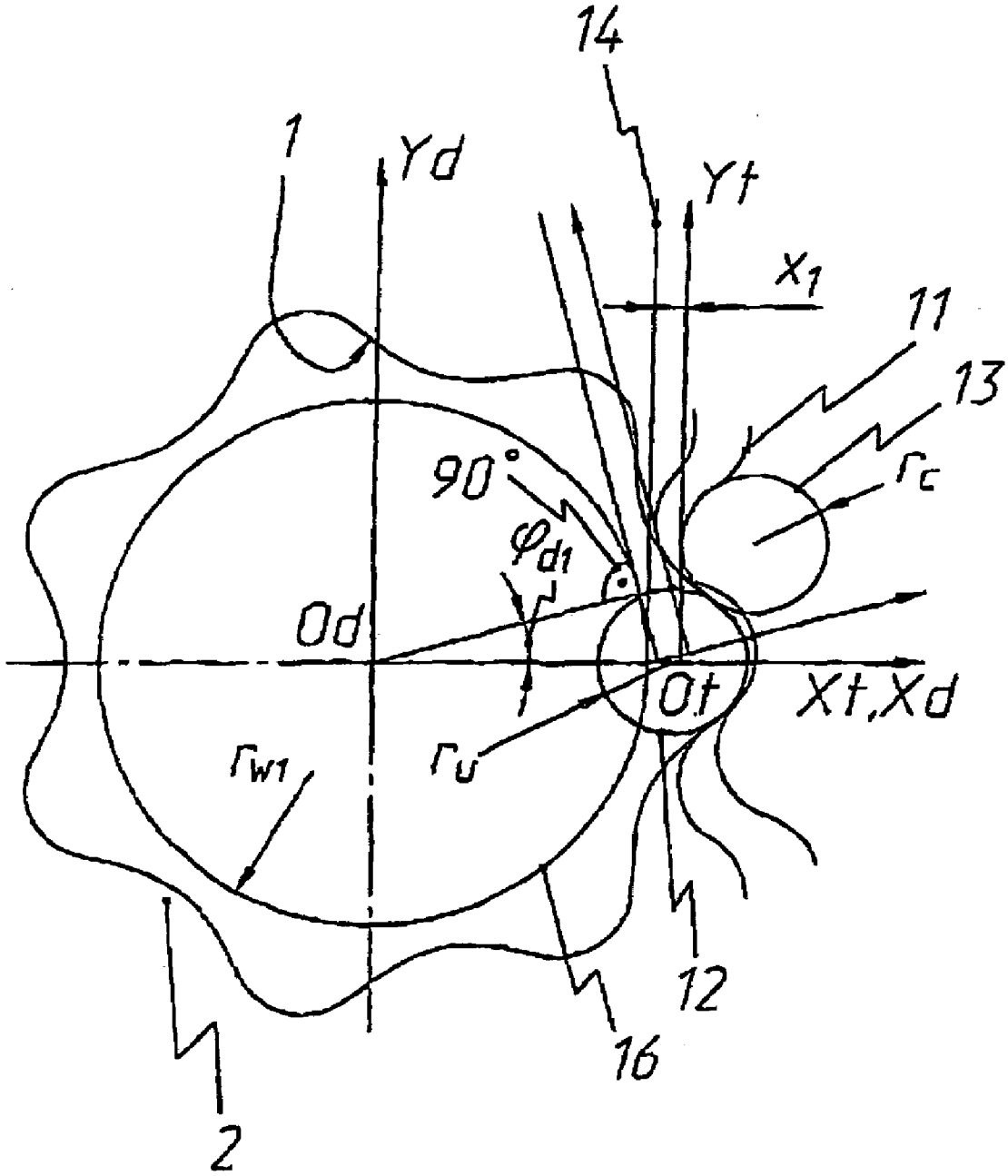
FIG. 5 shows a diagram for generating the stator profile basing on the rack-type tool initial contour generated by conjugation of circular arcs.

The essential feature of profiles of teeth of rotor 3 and/or stator 1 in the end-face section of the gerotor mechanism consists in that said profiles are defined as the envelopes of the rack-type tool initial contour 11 generated by conjugation of circles 12 and 13 having radii $r_i$ and $r_c$, respectively (see FIGS. 4 and 5). Profile of teeth 4 and 2 is generated when tool's straight line 14 and initial contour 11 associated therewith revolve without sliding around the respective tool's circumferences. As this occurs, the arc having radius $r_i$ predominantly forms the profile of apex of tooth 4 of rotor 3 according to FIG. 4, and profile of space of tooth 2 of stator 1 according to FIG. 5; and the arc having radius $r_c$ predominantly forms the profile of space of tooth 4 of rotor 3 according to FIG. 4 and profile of apex of tooth 2 stator 1 according to FIG. 5. Radii of tool's circumferences 15 of rotor 3 and 16 of stator 1, according to FIGS. 4 and 5, are selected basing on a number of teeth and an eccentricity value. For provision of predetermined diameters of rotor 3 with respect to projections of teeth 4, and of stator 1 with respect to spaces of teeth 2: values of shift $x_2$ and $x_1$ of the initial contours of the rotor and stator, respectively, are defined FIGS. 4 and 5. Here profile of rotor 3 in its end-section is determined by the following expressions:

$$X_{d2}=(X_{n(m)}+r_{w2}+x_2)\cos\phi_{d2}-(Y_{n(m)}-r_{w2}\phi_{d2})\sin\phi_{d2},$$

$$X_{d2}=(X_{n(m)}+r_{w2}+x_2)\sin\phi_{d1}+(Y_{n(n)}-r_{w2}\phi_{d2})\cos\phi_{d2},$$

and the stator profile in its end-face section is determined by the following expressions:

$$X_{d1}=(X_{n(m)}+r_{w1}+x_1)\cos\phi_{d1}-(Y_{n(m)}-r_{w1}\phi_{d1})\sin\phi_{d1},$$

$$X_{d1}=(X_{n(m)}+r_{w1}+x_1)\sin\phi_{d1}+(Y_{n(m)}-r_{w1}\phi_{d1})\cos\phi_{d1},$$

where $$\phi_{d2}=2[(Y_{n(m)}-(x_2+x_{n(m)})\mathrm{ctg}\alpha_{pt})/d_{w2}],$$

$$\phi_{d1}=2[(Y_{n(m)}-(x_1+X_{n(m)})\mathrm{ctg}\alpha_{pt})/d_{w1}]$$

are the angles of rotation of a moving coordinate system $X_tO_tY_t$ tied to the rack-type tool relative to the rest coordinate system $X_dO_dY_d$ tied to the centre of the corresponding tool s circumference (FIGS. 4 and 5).

Figure 6:
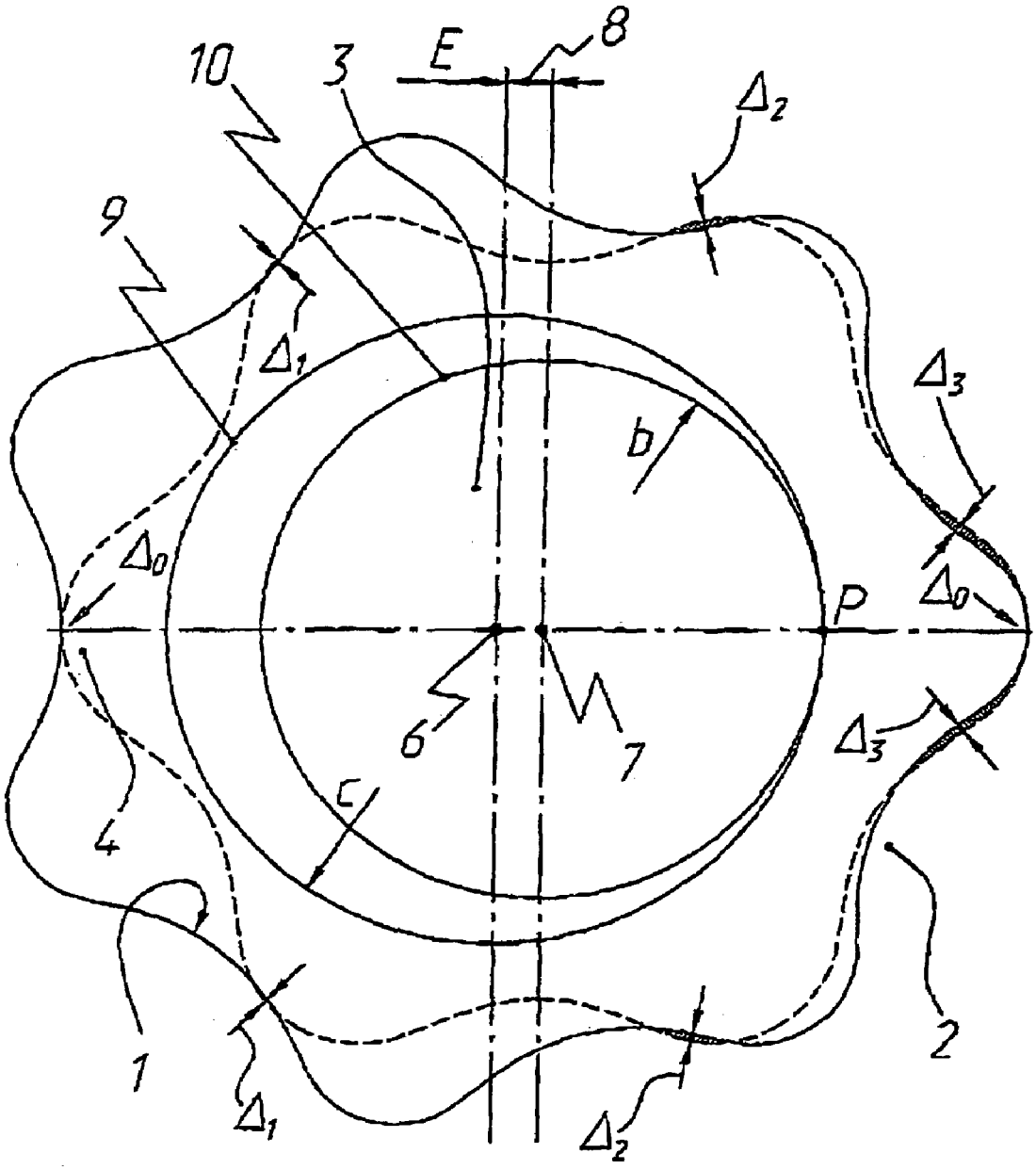
FIG. 6 shows an example of meshing of the stator and rotor, with the zero radial interference, when the lateral interferences are present (shown as enlarged).

According to an exemplary embodiment of the claimed gerotor mechanism in meshing of stator—and rotor 3—the radial interference $\Delta_0$ is not present when there are lateral interferences $\Delta_1$, $\Delta_2$, $\Delta_3$, —FIG. 6. The example shows meshing of profile of rotor 3 defined as the envelope of initial contour 11 of the rack-type tool and generated by conjugation of circular arcs having coefficient K greater than 1; and meshing of profile of stator 1 defined as the envelope of the rack-type tool initial contour generated by the curtailed cycloid equidistance. In this example, the lateral interference is distributed in the manner according to which said interference diminishes from the minimum sliding speeds towards the zones where the sliding speeds are maximal, i.e. towards the zones farthermost from pitch point P ($\Delta_1<\Delta_2<\Delta_3$), FIG. 6, which feature provides high energy characteristics of the mechanism and mitigates wear of apices of resilient-elastic teeth 2 of stator 1 and apices of teeth 4 of rotor 3.

Figure 7:
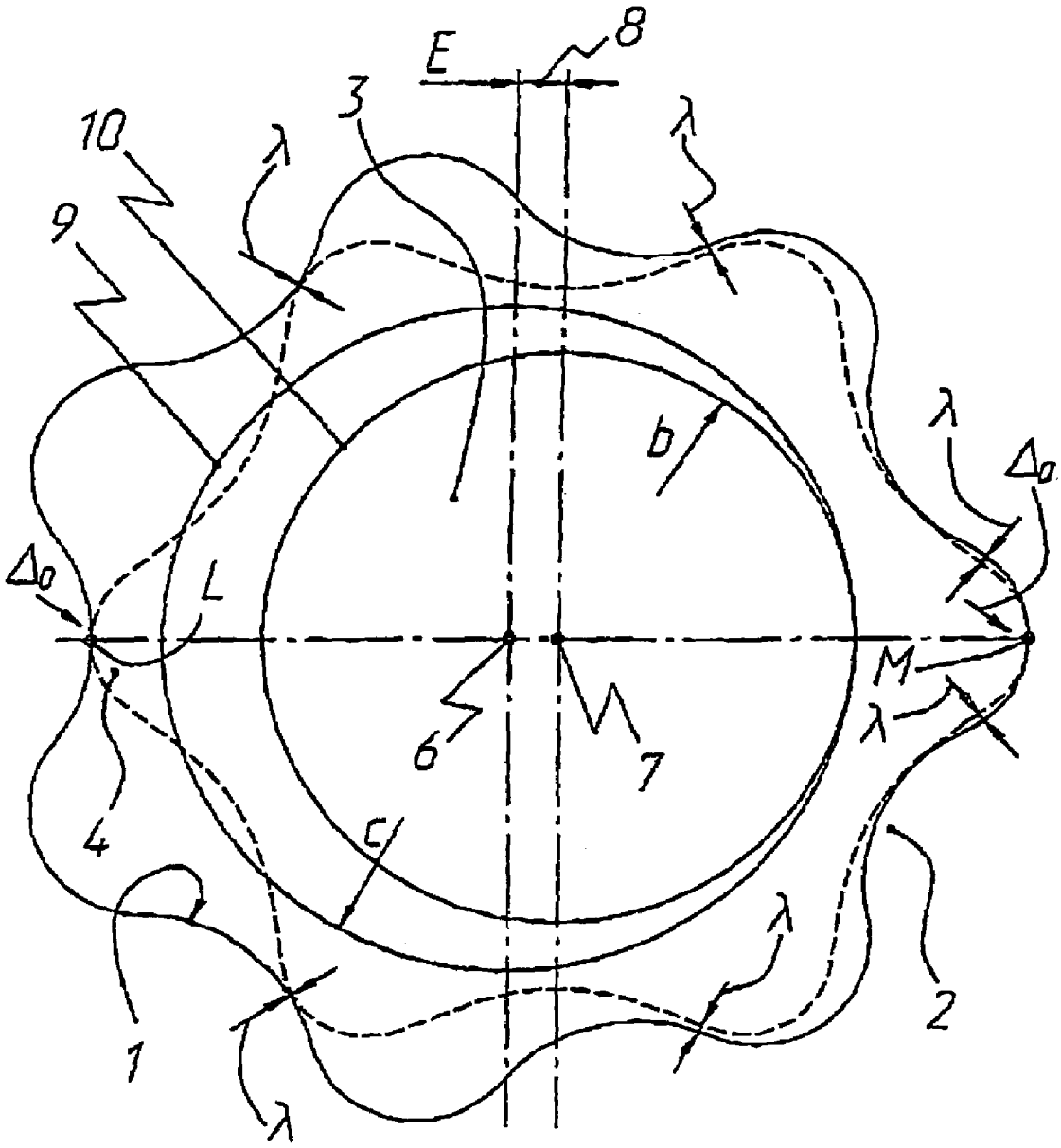
FIG. 7 shows an example of meshing of epy stator and rotor for use in hot wells, with the zero radial interference, when the side clearances are present (shown as enlarged).

According to another example of embodiment of the claimed gerotor mechanism: in meshing of stator 1 and rotor 3—the radial interference $\Delta_0$ is not present when there are side clearances $\lambda$—FIG. 7. The example shows meshing of profile of rotor 3 defined as the envelope of the rack-type tool initial contour 11 generated by conjugation of circular arcs having coefficient K less than 1; and meshing of the stator 1 profile defined as the envelope of the rack-type tool initial contour generated by the curtailed cycloid equidistance. According to this example: side clearances $\lambda$ are distributed such that as compared with a mechanism having the uniform clearance in meshing provided are higher energy characteristics of a gerotor mechanism during its operation in hot wells (at temperatures over 100° C.), and the negative influence of the skewing moment is weakened owing to the contact provided at points L and M, according to FIG. 7, and ditto probability that seizure of the gerotor mechanism would occur in a hot well.

Figure 8:
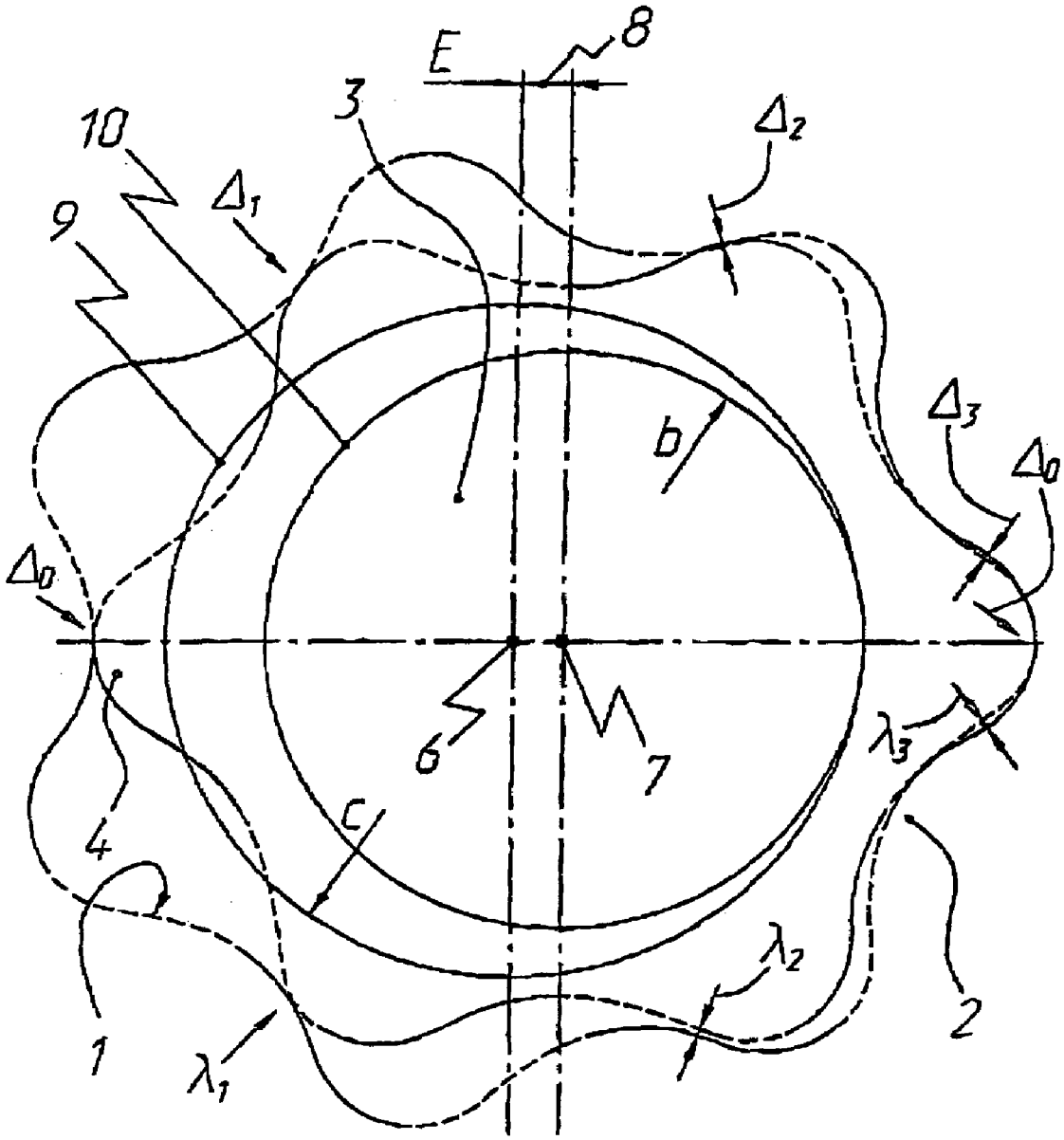
FIG. 8 shows an example of meshing of the stator and rotor whose one half of the profile of each of the teeth is defined as the envelope of the cycloidal rack (clearances and interferences are enlarged).

According to another example of embodiment of the claimed gerotor mechanism: when in meshing of stator 1 and rotor 3 the radial interference $\Delta_0$ is absent and there are side clearances $\lambda_1$, $\lambda_2$, $\lambda_3$, and lateral interferences $\lambda_1$, $\lambda_2$, $\lambda_3$—FIG. 8. This example shows meshing of rotor 3 and stator 1 wherein one half of profile of each one of the teeth is defined as the envelope of the rack-type tool initial contour generated by conjugation of circular arcs having coefficient K lesser than 1, and the other half of the tooth profile being defined as the envelope of the rack-type tool initial contour generated by the curtailed cycloid equidistance. Rotor 3 and stator 1 being assembled such that the profiles—defined as the envelopes of the rack-type tool initial contour 11 generated by conjugation of circular arcs are in contact, in meshing, with the profiles defined as the envelopes of the rack-type tool initial contour generated by the curtailed cycloid equidistance. In this example there are side clearances $\lambda_1$; , $\lambda_2$, $\lambda_3$, and lateral interferences $\Delta_1$, $\Delta_2$, $\Delta_3$, according to FIG. 8, which circumstances allows to mitigate the one-sided wear of teeth by diminishing the contact stresses that take place in the maximum sliding speeds zones and in the zones of minimal angles of pressure. Further, owing to a pressure difference that appears between the recesses having side clearances and the recesses having lateral interferences: the negative influence of the skewing moment is reduced, for said recesses are distributed evenly along entire length of the gerotor mechanism.

Also possible are further versions of meshing to be provided in the gerotor mechanisms, wherein the correlation adjustment of a tooth shape and modification of an interference value are provided by selection of optimal values of coefficient K and shifts $x_1$ and $x_2$ of the rack-type tool initial contours in the course of designing a mechanism.

The claimed gerotor mechanism of a downhole hydraulic motor operates as follows. When a gerotor mechanism is employed in a screw downhole motor: washing fluid is delivered into the upper portion of the gerotor mechanism via a drill string (not shown). Under action of the washing fluid pressure difference, rotor 3 performs the planetary motion within stator 1, around which rotor revolve helical teeth 4 along helical teeth 3 of stator 1, FIG. 1. In so doing, axis 7 of rotor 3 rotates about axis 6 of stator 1 along the circle having radius E, and rotor 3 itself rotates about its axis 7 in the direction that is opposite to the planetary motion, FIG. 2.

In terms of kinematics, movement of rotor 3 with respect to stator 1 is determined by rolling, without sliding, of centroid 10 of rotor 3 having radius $b=Ez_2$ along centroid 9 of stator 1 having radius $c=Ez_1$, the immediate center of rotation of rotor 3 being disposed at the point of tangency of centroids at pitch point P: FIG. 2. When the meshing takes place, the recesses of high and low pressures are divided along the contact lines, and in this case if there are lateral interferences, then a reliable tightness between the high- and low pressure recesses is provided, which circumstance helps decrease leakages of the working fluid and, consequently, improves the energy characteristics of the claimed gerotor mechanism (capacity and efficiency). Further, for the reason that there is no radial interference and any decrease in the contact stresses in the zone farthermost from the pitch point, where the sliding speeds are the greatest, according to FIG. 6, so the moment of the resistance forces lowers, and apices of teeth 2 of stator 1 and teeth 4 of rotor 3 are worn less, which is also conducive to improvement of the energy characteristics of the gerotor mechanism and its wear-resistance. When there are side clearances in meshing (a mechanism for operation in a hot well), the operation principle of the mechanism is similar to that which is discussed above; tightness being ensured by expansion of resilient-elastic teeth 2 of stator 1 and of teeth 4 of rotor 3; thereby the contact stresses and, accordingly, the friction forces in the mechanism are optimal for ensuring its high energy characteristics and an high wear resistance.

Planetary motion of rotor 3 is transferred to the supporting assembly shaft and to a rock-destruction tool associated therewith.

When the claimed gerotor mechanism is used in the screw pumps: rotor 3 is caused to rotate and, revolving around teeth 2 of stator 1, converts the rotation mechanical energy to the hydraulic energy of a fluid flow. Kinematics of motion of rotor 3 of a screw pump and the advantages obtained by using the claimed embodiments of a gerotor mechanism are similar to those described in respect of a screw motor.

INDUSTRIAL APPLICABILITY

The invention can be suitably used in oil producing industry in the operations for extracting oil and for pumping of fluids, as well as in other industries where various fluids are pumped.

The invention claimed is:

1. A gerotor mechanism for a screw hydraulic machine, said gerotor mechanism comprising a stator having inner helical teeth made of a elastoplastic material, and a rotor having outer helical teeth whose number by one tooth is less than that of the stator, leads of screw lines in the stator and the rotor being proportional to numbers of their teeth, a rotor axis being shifted with respect to a stator axis by an eccentricity value equal to half of the rotor/stator teeth radial height;

wherein profiles of the rotor and/or stator are outlined in end cross section thereof in the form of an envelop of an initial contour of a rack-type tool, which contour is formed by conjugation of circle arcs when said initial contour of the rack-type tool is run without sliding along corresponding toll circles, and radii of the circle arcs of the initial contour being calculated according to the following expressions:

$$r_i=K[(\pi^2 r_{w1}^2/4Ez_1^2)+E]/(K+1)$$

or $$r_i=K[(\pi^2 r_{w2}^2/4Ez_2^2)+E]/(K+1),$$

$$r_c=r_i/K,$$

where $r_i$ is an initial radius of the rack-type tool profile,

K=(0.5 . . . 2) is a shape coefficient of the initial contour, $r_{w1}$, $r_{w2}$ are radii of tool circles of the rotor and the stator, respectively;

E is eccentricity of meshing, $z_1$, $z_2$ are numbers of teeth of the stator and the rotor, respectively;

$r_c$ is conjugated radius of the rack-type tool profile.

2. The gerotor mechanism for a screw hydraulic machine according to claim 1, wherein profile of a half of each of the teeth in end cross section of the rotor and/or the stator is defined as an envelope of the rack-type tool initial contour formed by a curtailed cycloid equidistance when the rack-type tool initial contour is run without sliding along the corresponding tool circle.

3. A gerotor mechanics according to claim 1, wherein the inner helical teeth of the stator are made of rubber.

* * * * *